US007823425B2

(12) United States Patent
Crossley

(10) Patent No.: US 7,823,425 B2
(45) Date of Patent: Nov. 2, 2010

(54) CARDLOCK MECHANSIM

(75) Inventor: David W. Crossley, Charlestown, RI (US)

(73) Assignee: Elbee Pty Ltd., Bondi Junction (AU)

( * ) Notice: Subject to any disclaimer, the term of this patent is extended or adjusted under 35 U.S.C. 154(b) by 310 days.

(21) Appl. No.: 11/789,041

(22) Filed: Apr. 23, 2007

(65) Prior Publication Data

US 2008/0256993 A1 Oct. 23, 2008

(51) Int. Cl.
*E05B 65/44* (2006.01)
*E05C 9/10* (2006.01)
*E05C 1/08* (2006.01)

(52) U.S. Cl. ..... 70/80; 70/85; 70/142; 70/345; 70/387; 292/36; 292/139; 292/150

(58) Field of Classification Search ..... 70/57, 70/57.1, 58, 63, 79, 81, 85, 405, 80, 141, 70/142, 337, 339, 345, 346, 353, 387; 292/32, 292/34, 36, 37, 42, 137–140, 146, 150
See application file for complete search history.

(56) References Cited

U.S. PATENT DOCUMENTS

| | | | | |
|---|---|---|---|---|
| 76,066 A | | 3/1868 | Felter | |
| 10,012 A | | 1/1882 | Taylor | |
| 293,375 A | | 2/1884 | Teeters | |
| 345,337 A | | 7/1886 | Tollner | |
| 429,795 A | | 6/1890 | Pusey | |
| 481,889 A | | 8/1892 | Blaney | |
| 771,584 A | | 10/1904 | Stephens | |
| 774,823 A | * | 11/1904 | Birkedal | 70/134 |
| 960,421 A | | 6/1910 | Sibley | |
| 1,026,591 A | | 5/1912 | Kohler | |
| 1,104,493 A | | 7/1914 | Hale | |
| 1,129,841 A | | 3/1915 | Bell | |

(Continued)

OTHER PUBLICATIONS

Hettich International "Easy Lock" product website printout (2 pgs.) (assume prior art).

(Continued)

*Primary Examiner*—Suzanne Dino Barrett
*Assistant Examiner*—Christopher Boswell
(74) *Attorney, Agent, or Firm*—Wolf, Greenfield & Sacks, P.C.

(57) ABSTRACT

A latch assembly for preventing access into a door or drawer is provided. The latch assembly includes a housing configured to mount on a door or drawer, and at least one dog is slidably mounted in the housing for movement between a locked position and an unlocked position. The latch assembly include actuators operatively connected to the dog for moving the dog to the unlocked position. A key is insertable into a key slot on a side of the housing to move the actuators. The latch assembly may be used in combination with a catch assembly configured to mount on a door or drawer frame. The catch assembly is constructed to engage at least a portion of the dog in the locked position. The catch assembly may include a spring to move the latch assembly relative to the catch assembly such that the door or drawer may open slightly while in the locked position enabling a key to be inserted into the key slot to move the dog to the unlocked position.

17 Claims, 9 Drawing Sheets

U.S. PATENT DOCUMENTS

| | | | | | |
|---|---|---|---|---|---|
| 1,320,028 | A | | 10/1919 | Sardo | |
| 1,526,110 | A | | 2/1925 | Bachmann | |
| 1,743,331 | A | * | 1/1930 | Ellison | 70/38 A |
| 3,654,783 | A | * | 4/1972 | Sinclair | 70/349 |
| 3,797,870 | A | * | 3/1974 | Beckman | 70/84 |
| 3,971,237 | A | * | 7/1976 | Rasmussen | 70/99 |
| 4,149,394 | A | | 4/1979 | Sornes | |
| 4,378,948 | A | * | 4/1983 | Chrones | 292/19 |
| 4,416,477 | A | * | 11/1983 | Bialobrzeski et al. | 292/19 |
| 4,462,230 | A | | 7/1984 | Evans | |
| 4,838,058 | A | * | 6/1989 | Matsumoto | 70/355 |
| 5,025,647 | A | * | 6/1991 | Muus | 70/352 |
| 5,146,770 | A | * | 9/1992 | Yun-Sheng | 70/38 C |
| 5,212,974 | A | * | 5/1993 | Shen | 70/352 |
| 5,355,701 | A | * | 10/1994 | Tobias | 70/394 |
| 5,375,712 | A | * | 12/1994 | Weisburn | 292/152 |
| 5,445,451 | A | * | 8/1995 | Harmony | 312/333 |
| 5,493,880 | A | * | 2/1996 | Jang | 70/202 |
| 5,669,254 | A | * | 9/1997 | Lee | 70/38 A |
| 6,102,200 | A | * | 8/2000 | Dressen et al. | 206/308.2 |
| 6,374,648 | B1 | * | 4/2002 | Mitsuyama | 70/57.1 |
| 6,499,327 | B1 | * | 12/2002 | Sugimoto | 70/423 |
| 6,529,384 | B1 | | 3/2003 | Haggstrom | |
| 6,776,016 | B1 | * | 8/2004 | Wittwer et al. | 70/252 |
| 6,851,554 | B2 | * | 2/2005 | Byrne et al. | 70/57.1 |
| 7,062,943 | B2 | | 6/2006 | Parsons | |
| 7,131,301 | B1 | * | 11/2006 | Chang | 70/134 |
| 7,377,139 | B1 | * | 5/2008 | Yang | 70/78 |
| 2003/0155778 | A1 | | 8/2003 | Dorn | |
| 2005/0160774 | A1 | * | 7/2005 | Weinstein et al. | 70/57.1 |

OTHER PUBLICATIONS

International Search Report and Written Opinion from corresponding PCT/US08/04313 application dated Jun. 26, 2008.

* cited by examiner

CARDLOCK MECHANSIM

FIELD OF INVENTION

This invention relates to locks particularly suited to child proof cabinet or desk doors and drawers.

SUMMARY OF INVENTION

In accordance with one aspect of the invention a first portion of a lock mechanism is designed to be mounted on the inside of a door or drawer and is moveable with respect to a cabinet frame. A second portion of the lock mechanism is designed to be mounted on the cabinet frame.

In accordance with another aspect of the invention, a lock has a plurality of key openings so that the lock may be mounted in a variety of positions on a door or drawer dictated by the physical characteristics of the cabinet, i.e. whether the cabinet door is hinged on the left or right side. This versatility is achieved without the need of any alterations or adjustments of the lock mechanism.

In accordance with yet another aspect of the invention, the key slots in the lock are hidden when the door or drawer carrying the lock is closed so that a child may not, when attempting to unlock the door or drawer, stumble upon the method of actuating the lock.

In accordance with yet another aspect of the invention, the lock may have built in safety features that require two separate latching devices to be actuated in order to fully open the door or drawer protected by the lock, but with a single actuation of a key both latching devices are simultaneously opened to gain access to the cabinet.

In one aspect, a latch assembly is disclosed. In particular, the latch assembly includes a housing configured to mount on a door or drawer, a first and a second dog slidably mounted in the housing for movement between a locked position and an unlocked position, where the first dog is separately moveable from the second dog. A first and second pair of actuators are mounted in the housing. Each pair may have one of its actuators operatively connected to the first dog and the other actuator operatively connected to the second dog for moving the dogs between the locked position and the unlocked position. The latch assembly further includes a first key slot on a first side of the housing configured such that a key is insertable into the first key slot to move the first pair of actuators, and a second key slot on a second side of the housing configured such that a key is insertable into the second key slot to move the second pair of actuators.

In another aspect of the invention, a door or drawer lock is disclosed. In particular, the lock includes a latch assembly for mounting on a door or drawer, and a catch assembly for mounting on a fixed door or drawer frame. The latch assembly includes a housing, and a dog mounted in the housing movable between an extended locked position and a retracted unlocked position. The latch assembly further includes actuators on opposite sides of and operatively connected to the dog for moving the dog to the retracted unlocked position, and a key slot in the housing adjacent each of the actuators configured such that a card key is insertable into the key slot to selectively move either actuator to move the dog to the retracted unlocked position. The catch assembly is constructed to engage at least a portion of the dog in the extended locked position. The catch assembly includes a spring to enable movement of the latch assembly relative to the catch assembly such that the door or drawer may open slightly while in the locked position enabling a key to be inserted into the key slot to move the dog to a retracted unlocked position.

In yet another aspect of the invention, a lock for child proofing a cabinet having a fixed frame with at least one drawer or door is disclosed. In particular, the lock includes a latch housing for mounting on the inner face of a moveable door or drawer, and a first and second dog separately moveable in the housing between a locked position where a locking portion of each of the dogs extends outside of the housing and an unlocked position where the locking portion of each of the dogs retracts into the housing. The lock further includes a first and second pair of actuators mounted in the housing with each pair having one of its actuators operatively connected to the first dog and the other actuator operatively connected to the second dog for moving the dogs between the locked position and the unlocked position. The lock also includes first and second key openings on different portions of the housing, and a catch for mounting on a fixed cabinet frame. The catch includes a connector for engaging the locking portions of the first and second dogs to maintain the door or drawer in a closed position, where the door or drawer covers the key openings preventing access to said openings. A spring forms part of the catch enabling the door or drawer to be opened against the bias of the spring just sufficiently to provide access to the key opening, and a key configured to be insertable into the first and second key openings is provided so as to move either the first or second pair of actuators to withdraw the dogs from engagement with the catch connector.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
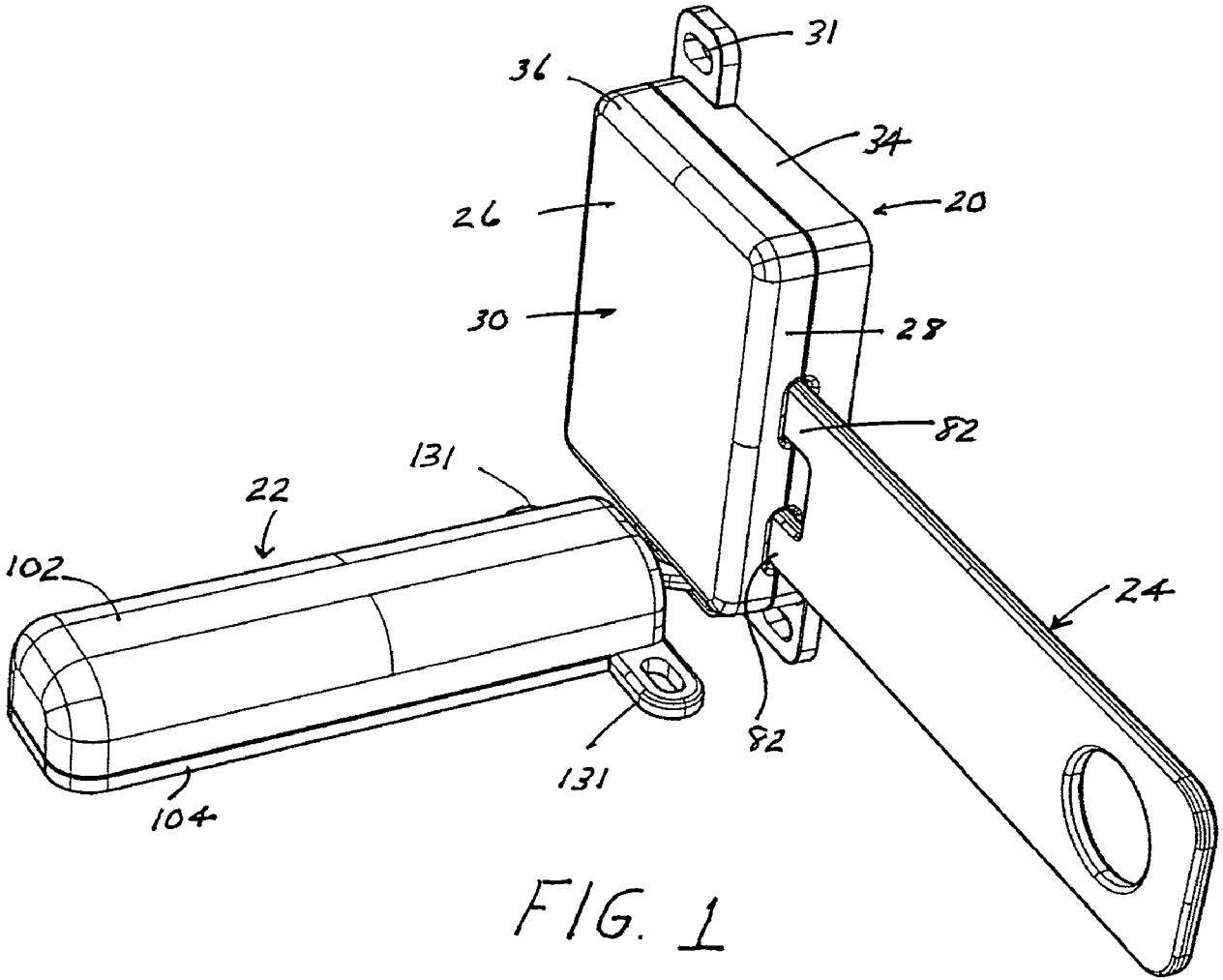
FIG. 1 is a perspective view of the lock assembly according to one embodiment of the present invention.
Figure 2:
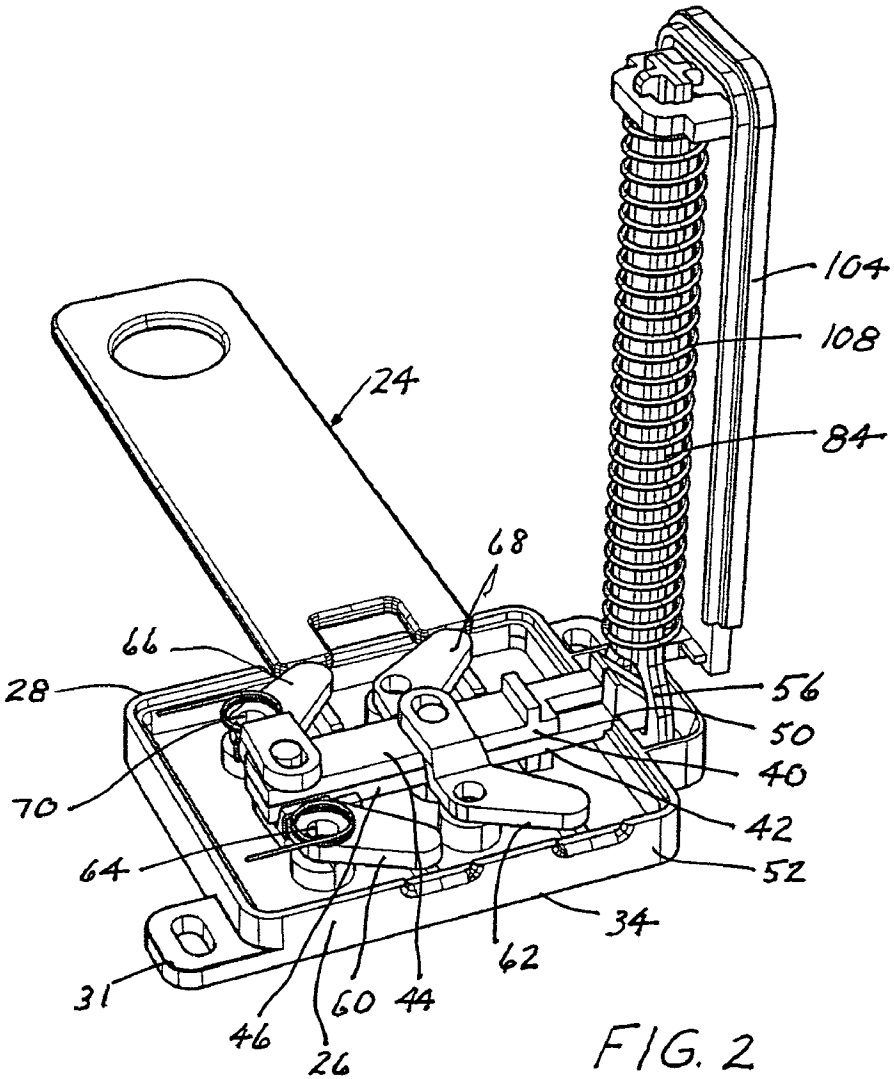
FIG. 2 is a perspective view of the lock assembly with the cover of the latch housing removed to expose the details of the mechanism.

The present invention relates to locks for door and/or drawers, and more particularly to a lock that may be mounted on the back or inside of a cabinet or desk door or drawer to prevent entry into the door or drawer. Such locks are typically used to restrict a child's entry into the door or drawer. Aspects of the present invention are directed to a lock with a card key which is inserted into a key slot to unlock the lock. In certain embodiments, a key slot is located on more than one side of the lock so that the lock may be configured for use with doors hinged on either the left side or the right side. This flexibility of use may be achieved without any alterations of the lock.

Turning now to the drawings, it should be appreciated that the drawings illustrate various components and features which may be incorporated into various embodiments of the present invention. For simplification, several drawings may illustrate more than one optional feature or component. However, the present invention is not limited to the specific embodiments disclosed in the drawings. It should be recognized that the present invention encompasses embodiments which may include only a portion of the components illustrated in any one figure, and/or may also encompass embodiments combining components illustrated in multiple different drawings, and/or may also encompass embodiments not explicitly disclosed in the drawings.

The lock assembly 10 of the present invention includes a latch 20, a catch 22 and a key 24. These parts are shown in the fully assembled operative relationship in FIG. 1 and in their partially disassembled or internally exposed condition in FIGS. 2-8. In use, the latch 20 is typically mounted on the inside of a door or drawer front, and the catch 22 is typically mounted to the door or drawer frame. The latch housing 30 may include a base 34 and cover 36 that together define a cavity 37 containing the latch mechanism. The key 24 accesses the interior of the latch 20 to open the lock through an opening in the side 26, 28 of the latch housing 30. As explained in greater detail below, the key 24 in accordance with one embodiment of the invention is a flat and double-toothed card key, and may be inserted into the housing 30 to operate the lock through the slots on either of the sides 26 or 28 of the latch housing 30.

The latch housing 30 is constructed to be mounted on the inside of the door or drawer. In the particular embodiment illustrated in FIGS. 1-4, brackets 31 are provided on the latch housing 30 to mount the latch 20 to the door or drawer. As shown, in this embodiment, brackets 31 are provided on both the top and the bottom of the housing 30. It should be appreciated that in other embodiments, brackets 31 may be provided at different locations on the housing 30 and the latch 20 may be mounted to the door or drawer in other fashions including but not limited to using an adhesive and various types of fasteners such as screws and nails, etc, which may be provided in addition to or in place of the brackets 31.

When the door or drawer is closed, the latch 20 is positioned to interact with and capture the catch 22 to prevent the door or drawer from being opened sufficiently to gain access to the interior of the cabinet. Portions of or all of the catch 22 may remain in a fixed position on the cabinet frame and the interaction between the latch 20 and the catch 22 keeps the door or drawer in a substantially closed position until the key 24 is inserted into the latch 20 to unlock the mechanism.

Figure 3:
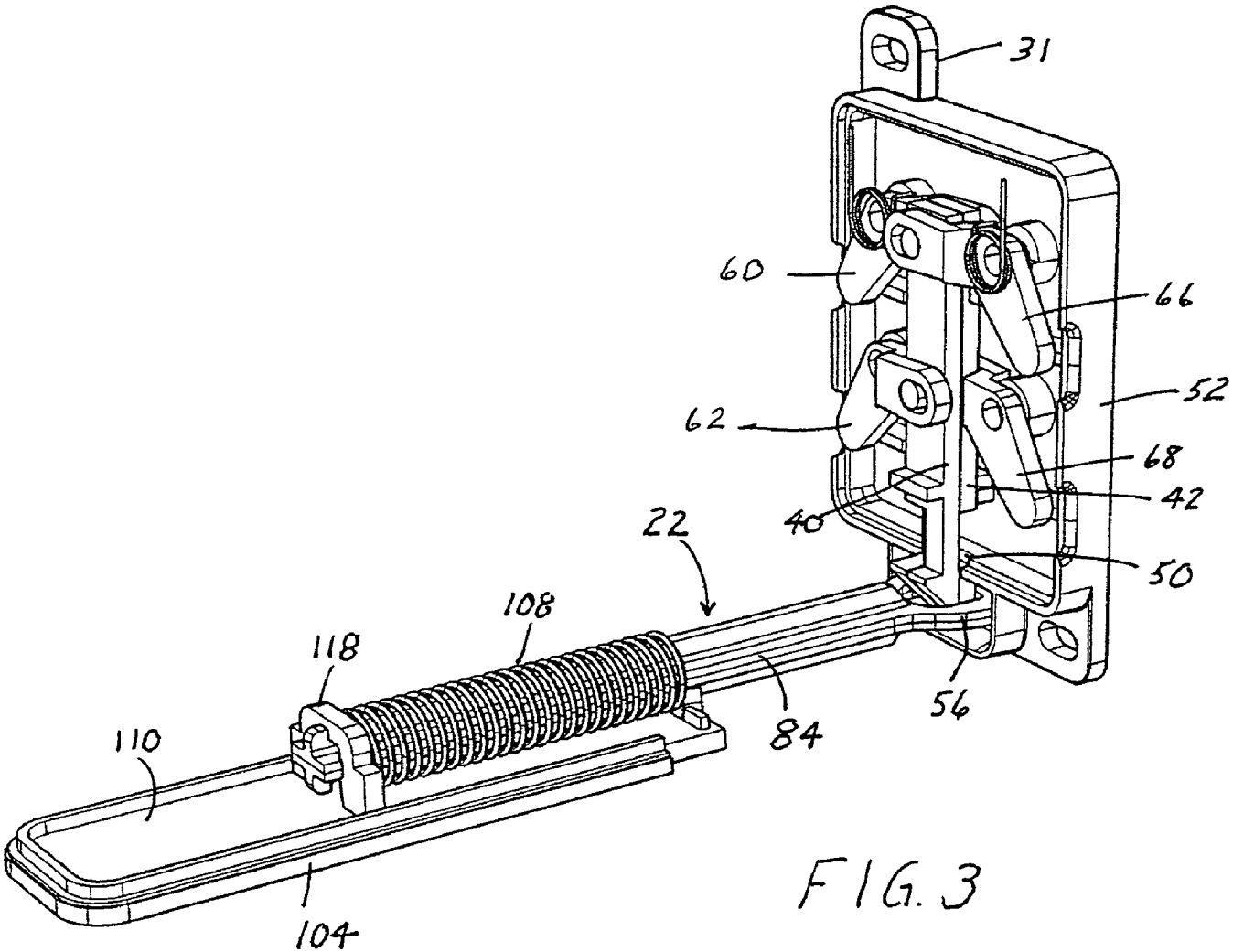
FIG. 3 is a perspective view of a portion of the lock assembly showing the action of the catch subassembly that allows the door or drawer to be partially opened with the lock engaged, so as to provide access for the key to open the lock so that the door or drawer can be fully opened.
Figure 4:
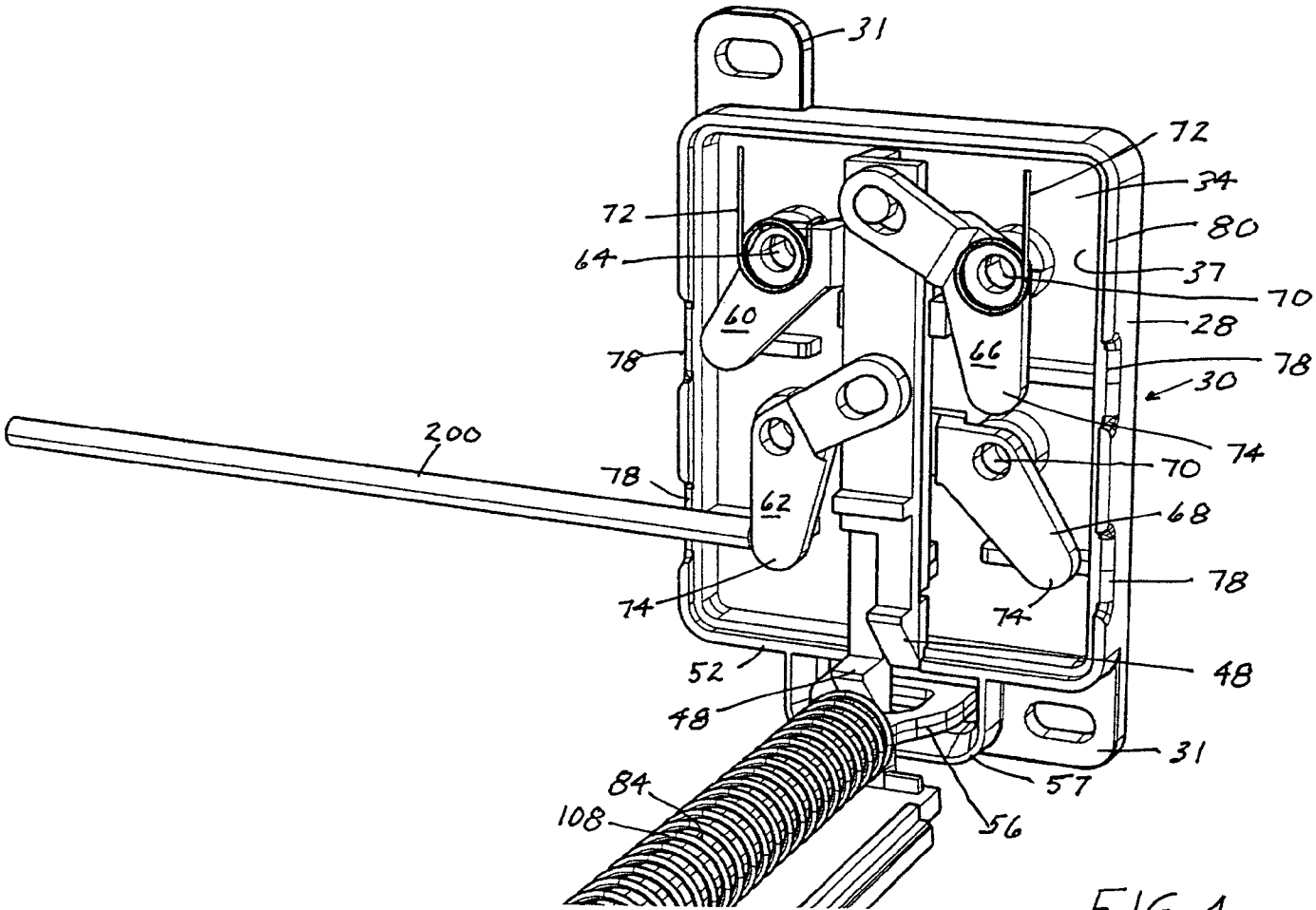
FIG. 4 is a perspective view of the lock assembly which demonstrates a safety feature of the mechanism that prevents the door or drawer to be fully opened when the lock mechanism is only partially actuated.

As shown in the embodiment illustrated in FIGS. 2-6, the latch mechanism includes a pair of slidably mounted dogs 40 and 42 whose bodies 44 and 46 are disposed one above the other but movable independently of one another. The pair of dogs 40, 42 may also be referred to as a first dog 40 and a second dog 42. Each dog has a head 48 that may extend out of the housing 30 through opening 50 in the flange 52 of the housing base 34. The heads 48 of the dogs 40 and 42 extend outside the housing so as to engage a connector portion of the catch, such as a plate 56 of the catch when the door or drawer is to be locked. In one embodiment, a guard 57 surrounds the heads 48 when they are in the extended or locking position as shown in FIG. 4.

The catch 22 includes a connector portion to selectively engage the latch 20. In one embodiment, the catch 22 includes a loop-shaped connector to engage at least a portion of the dogs 40, 42 in a locked position. For example, as shown in FIG. 4, in one embodiment, the plate 56 is loop-shaped connector. In another embodiment, the connector portion of the catch 22 that engages the latch may be shaped and configured differently. It should be appreciated that the configuration of the catch connector may depend upon the configuration of the heads 48 of the dogs 40, 42.

In accordance with one embodiment of this invention, actuators are mounted in the housing 30 to move the first and second dogs 40, 42 between a locked position and an unlocked position. In one embodiment, the actuators may include a pair of levers 60 and 62 mounted along one side of the pair of dogs 40 and 42 for pivotal motion on pivot posts 64, and a similar pair of levers 66 and 68 are mounted on the other side of the dogs within the housing for pivotal motion on another set of pivot posts 70. In this embodiment, the levers 62 and 66 are both pivotally connected to the dog 40, and the other levers 60 and 68 are pivotally connected to the other dog 42. Thus, the pair of levers on one side together are pivotally connected to both dogs. The same condition exists with respect to the pair of levers 66 and 68 on the other side of the dogs, that is, these levers on the other side together are connected to both dogs so that their actuation would serve to move both dogs in the housing. In the embodiment illustrated in FIG. 4, springs 72 connected to the levers 60 and 66 bias the dogs to their locking position such that the heads 48 extend out of the housing and engage a connector portion of the catch assembly 22.

Each of the levers 60, 62, 66 and 68 may be mounted on a post 64, 70 which serve as fulcrums, and each has a free end 74 disposed adjacent one of the openings 78 in the side flanges 80 of the housing base 34. The openings 78 on each flange 80 may be sized and spaced apart so as to simultaneously receive both of the teeth 82 of the key 24. Thus, when a key 24 is inserted through openings in one side of the housing, the levers on that side both pivot about their fulcrum and by their connection to the dogs 40 and 42, the dogs move translationally so as to withdraw their respective heads 48 from the catch plate 56 and into the housing 30. More specifically, when a key 24 is inserted through the openings 78 in the upper flange 80, as viewed in FIG. 2, the levers 66 and 68 move the dogs to the left so as to withdraw the heads 48 from the opening in the catch plate 56 to free the latch 20 from the catch 22 so as to enable the door or drawer to be opened. Similarly, if a key 24 is inserted into the openings 78 in the other side flange of the base 34 of the housing 30, the levers 60 and 62 respectively connected to the dogs 42 and 40 will also be withdrawn in a similar fashion from the opening in the catch plate 56 so as to release the lock.

In certain embodiments where the latch mechanism includes a pair of dogs 40 and 42, two levers must be actuated to retract both dogs 40, 42. As shown in FIG. 4, when an object 200 other than the key 24 is inserted into an opening 78 in the housing 30, one lever 62 may move to retract the first dog 40 into an unlocked position. However, the door or drawer may remain locked because the second dog 42 may remain engaged with the catch 22 in a locked position. Therefore, a latch assembly having a pair of independently moveable dogs 40, 42 may be used to prevent the ability of one to disengage the latch mechanism from a catch 22 without a certain shaped key 24.

As shown in FIG. 4, in one embodiment, a first key slot is provided on a first side 26 of the housing 30 configured such that a key 24 is insertable into the first key slot to move the first pair of actuators, and a second key slot is provided on a second side 28 of the housing 30 configured such that a key 24 is insertable into the second key slot to move the second pair of actuators. As shown in this particular embodiment, the first side 26 of the housing is opposite the second side 28 of the housing, such that the key slots are on opposite sides.

In the embodiment illustrated in FIG. 4, each side 26, 28 of the housing 30 includes two spaced apart openings 78. The two openings 78 on one side 26, 28 may define the first key slot, whereas the two openings 78 on the other side 26, 28 may define the second key slot. It should be appreciated that in some embodiments, the first and/or second key slot may include only one opening 78 which may be used to access a pair of levers 60, 62 or a pair of levers 66, 68 (i.e. there may be no side flange 80 section which spaces apart two openings 78 on one side 26, 28). In such embodiments, a key 24 having a certain end configuration may still be required to actuate the pair of levers.

As shown in FIG. 1, the catch 22 may include a cover 102 and a base 104 that together define a cavity 106 containing the catch mechanism. In the remaining figures, the cover 102 is not shown to better illustrate components within the catch 22.

The catch 22 is constructed to be mounted to a door or drawer frame. In the particular embodiment illustrated in FIG. 1, brackets 131 are provided on the catch cover 102 to mount the catch 22 to the door or drawer frame. As shown, in this embodiment, brackets 131 are provided at one end of the catch 22. It should be appreciated that in other embodiments, brackets 131 may be provided at different locations on the catch 22 and/or the catch 22 may be mounted to the door or drawer frame in other fashions including but not limited to using an adhesive and various types of fasteners such as screws and nails, etc, which may be provided in addition to or in place of the brackets 131.

Figure 6:
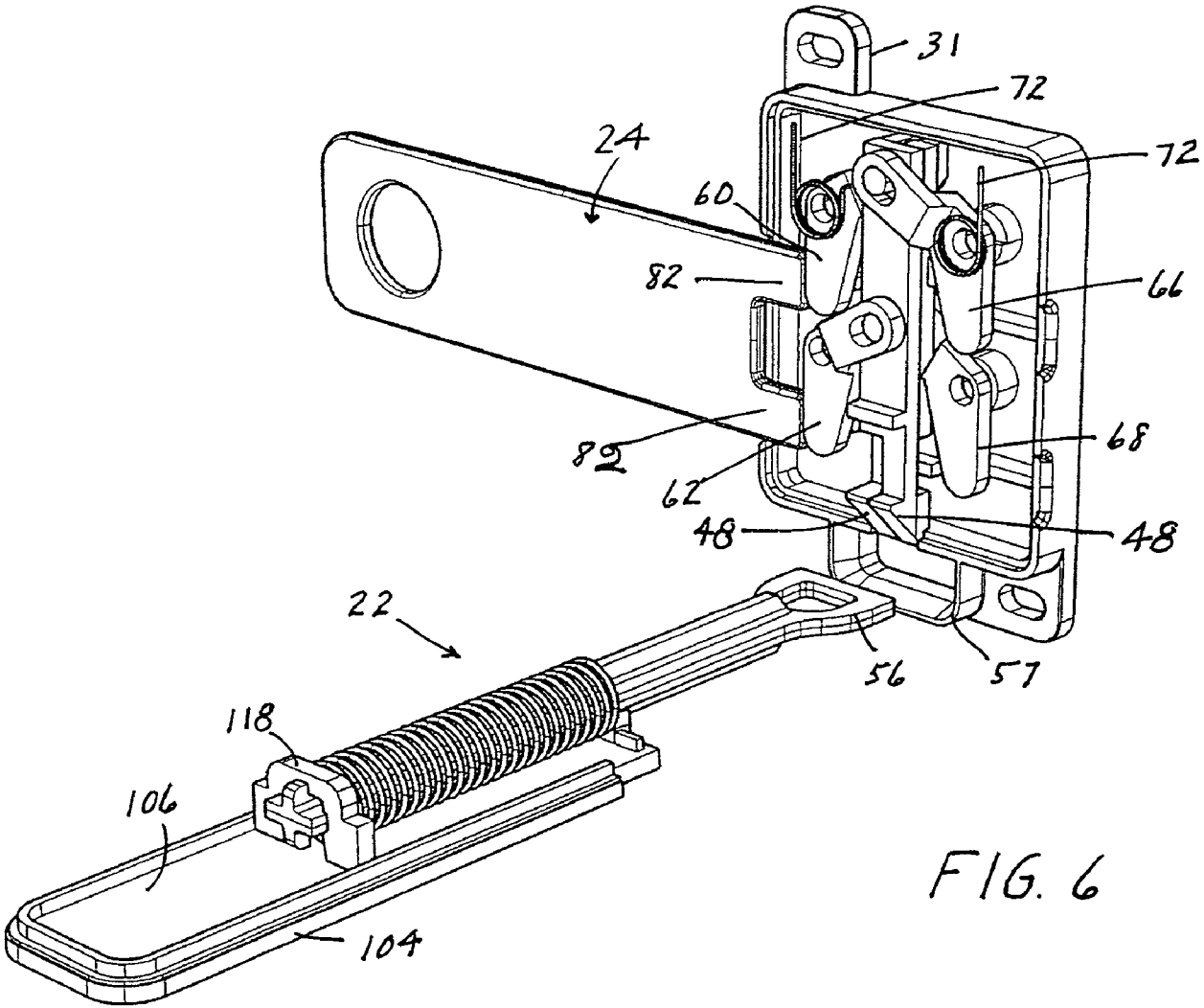
FIG. 6 is a perspective view of the lock assembly according to one embodiment of the present invention illustrating the operation of the key and catch assembly.
Figure 7:
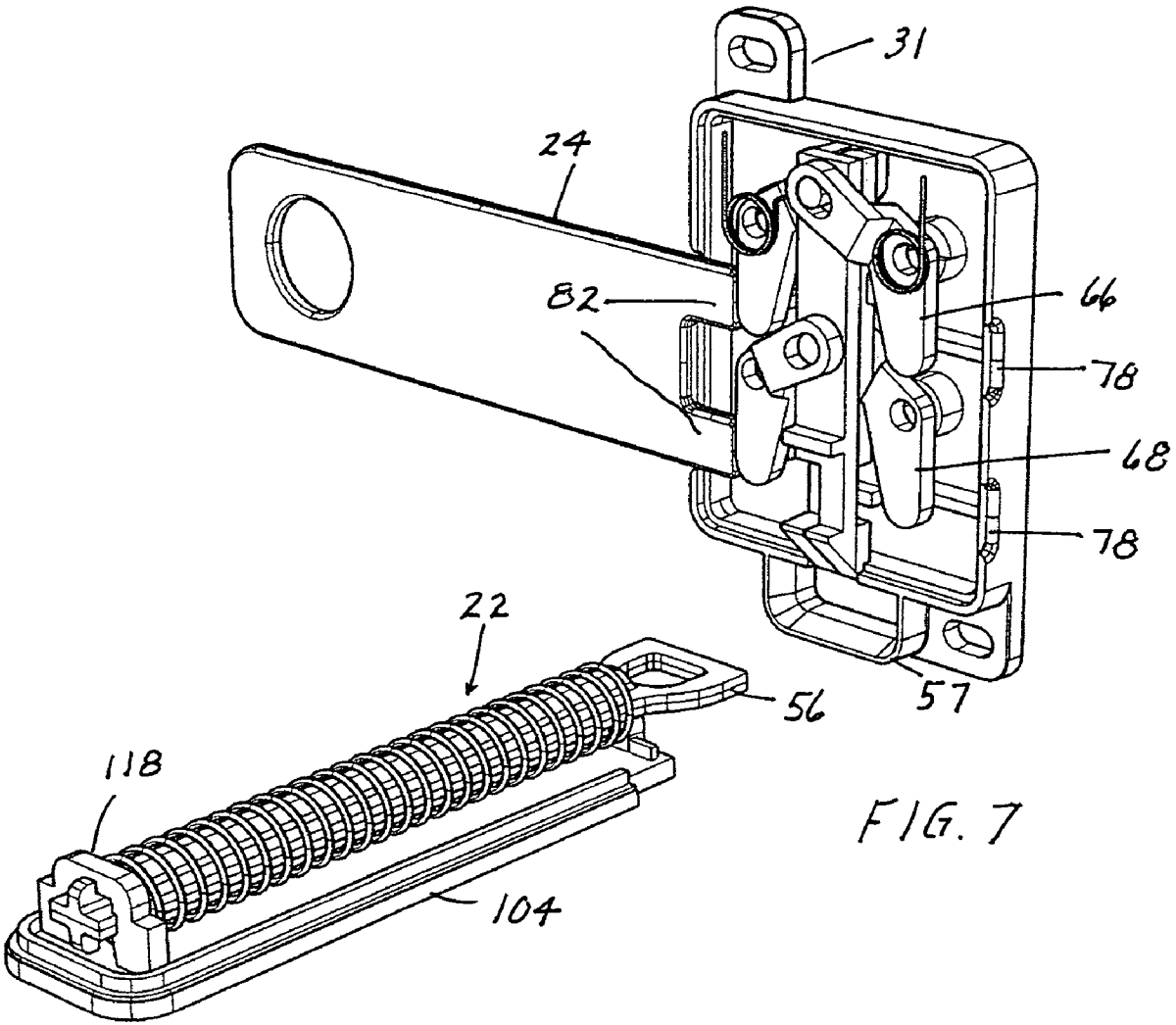
FIG. 7 is a perspective view of the lock assembly according to one embodiment of the present invention illustrating the operation of the key and catch assembly.

One embodiment of a catch 22 is illustrated in greater detail in FIGS. 3, 6 and 7. In FIG. 3, the catch 22 is engaged with the latch 20. In one embodiment, at least a portion of the latch assembly is moveable relative to the catch 22 in the locked position such that a key slot (such as at least either the first or second key slot) in the housing 30 is accessible to a key 24 in the locked position. In one embodiment, the connector portion of the catch 22 that is configured to engage the latch 20 (such as plate 56 of the catch) is slidably mounted to a track 110 which may be part of the catch base 104. In this respect, the base 104 and track 110 may remain fixedly secured to the door or door frame and the connector plate 56 of the catch 22 may slide relative to the base 104. In one particular embodiment, the catch 22 includes an end piece 118 which is configured to be slidably received within the track 110. Such a configuration enables one to open the door or drawer slightly to access a key opening 78 to unlock the mechanism. However, the arrangement may be configured such that the door or drawer may only opened slightly so that one cannot reach inside of the door or drawer when the assembly is still in a locked position. Rather, the relative movement of portions of the catch assembly 22 may only be enough to permit access to the openings 78 so that the key 24 may be inserted into the openings 78 to unlock the mechanism.

In one embodiment, the catch assembly 22 is spring loaded with spring 108 which is operatively connected to the catch 22. The spring 108 may be connected to the connector plate 56, for slideable movement therewith. For example, as shown in FIGS. 2, 3, 6, 7, the spring 108 may be a helical spring wrapped around a support 84 which operatively connects the catch plate 56 with the end piece 118. The spring 108 may enable movement of the latch assembly relative to the catch assembly such that the door or drawer may open slightly to access at least on of the first and second key slots.

As shown in FIG. 3, when there is an attempt to open the door or drawer, the spring loaded catch plate 56 may extend slightly to create a gap between the door or drawer and the corresponding door or drawer frame or cabinet. This gap allows for insertion of the key 24. As shown in FIG. 6, when the key 24 is inserted into the latch housing 30, it presses on the levers, causing the dogs 40, 42 to retract, releasing the catch 22 from its interaction with the latch 20. As shown in the FIG. 7, the spring loaded catch may then retract into its cavity 106 and may be ready to reattach to the latch when the door or drawer is closed again.

It should be appreciated that although some of the above-described embodiments are directed to a latch mechanism having a pair of dogs 40, 42, some embodiments of the present invention are directed to a latch mechanism which may include only one dog 40. As discussed above, movement of the dog 40 between a locked and unlocked position may be actuated from multiple sides of the housing 30, depending upon the configuration of the door or drawer.

Furthermore, it should also be appreciated that although some of the above-described embodiments are directed to an assembly having two pairs of levers 60, 62 and 66, 68 acting as a first and second pair of actuators with each pair having one actuator operatively connected to a first dog 40 and the other actuator operatively connected to a second dog 42, other embodiments may be configured differently. For example, other embodiments are directed to assemblies which may only include one dog 40. Such embodiments may include one actuator, such as a lever, on each side of and operatively connected to the dog 40 for moving the dog to a retracted unlocked position.

Figure 5:
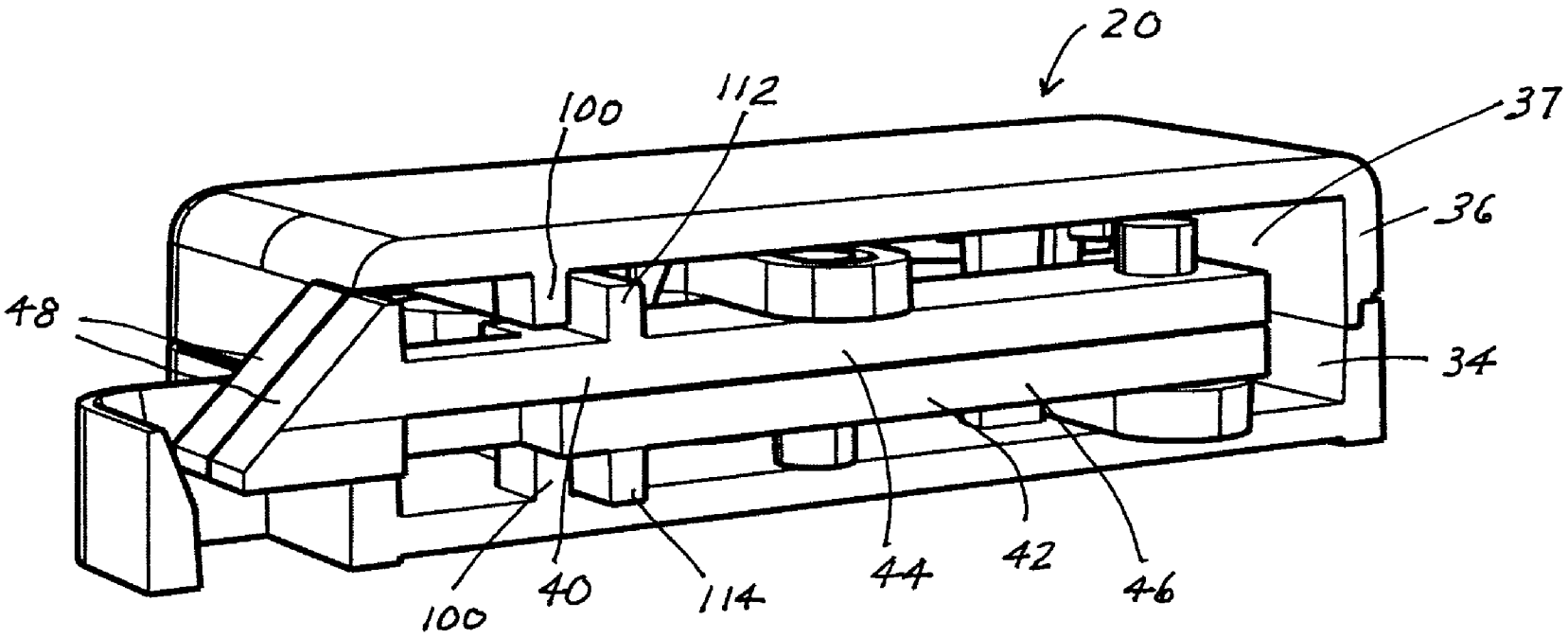
FIG. 5 is a cross sectional perspective view of the lock assembly according to one embodiment of the present invention.
Figure 8:
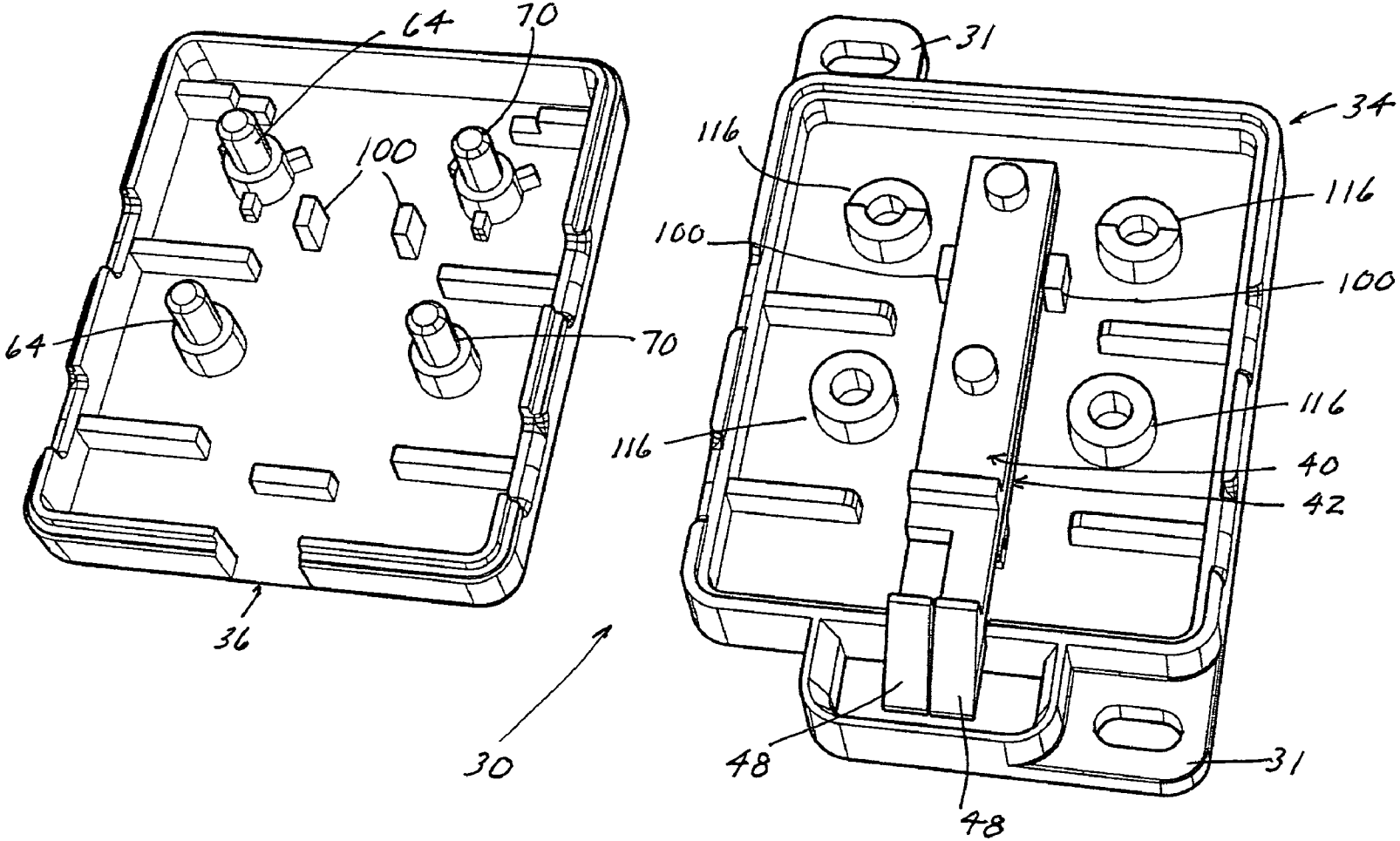
FIG. 8 is a perspective view of the latch housing according to one embodiment.

In FIGS. 5 and 8, one embodiment of the latch housing 30 is illustrated in greater detail. In this particular embodiment, the housing 30 includes a plurality of ribs 100 extending out from an inside surface of the housing 30. The ribs 100 may guide movement of the dogs 40, 42 between an extended position and a retracted position. The ribs 100 may extend out from an inside surface of both the base 34 and cover 36. As shown in FIG. 5, in one embodiment, protrusions 112 and 114 respectively on dogs 40 and 42 may interact with ribs 100 on the housing 30 to limit and/or guide movement of the dogs 40, 42 relative to the housing 30. Furthermore, as shown in FIG. 8, annular sections 116 may be provided on an inside surface of the housing opposite the posts 64, 70 to retain the levers 60, 62, 66, 68 on the posts 64, 70.

Figure 9:
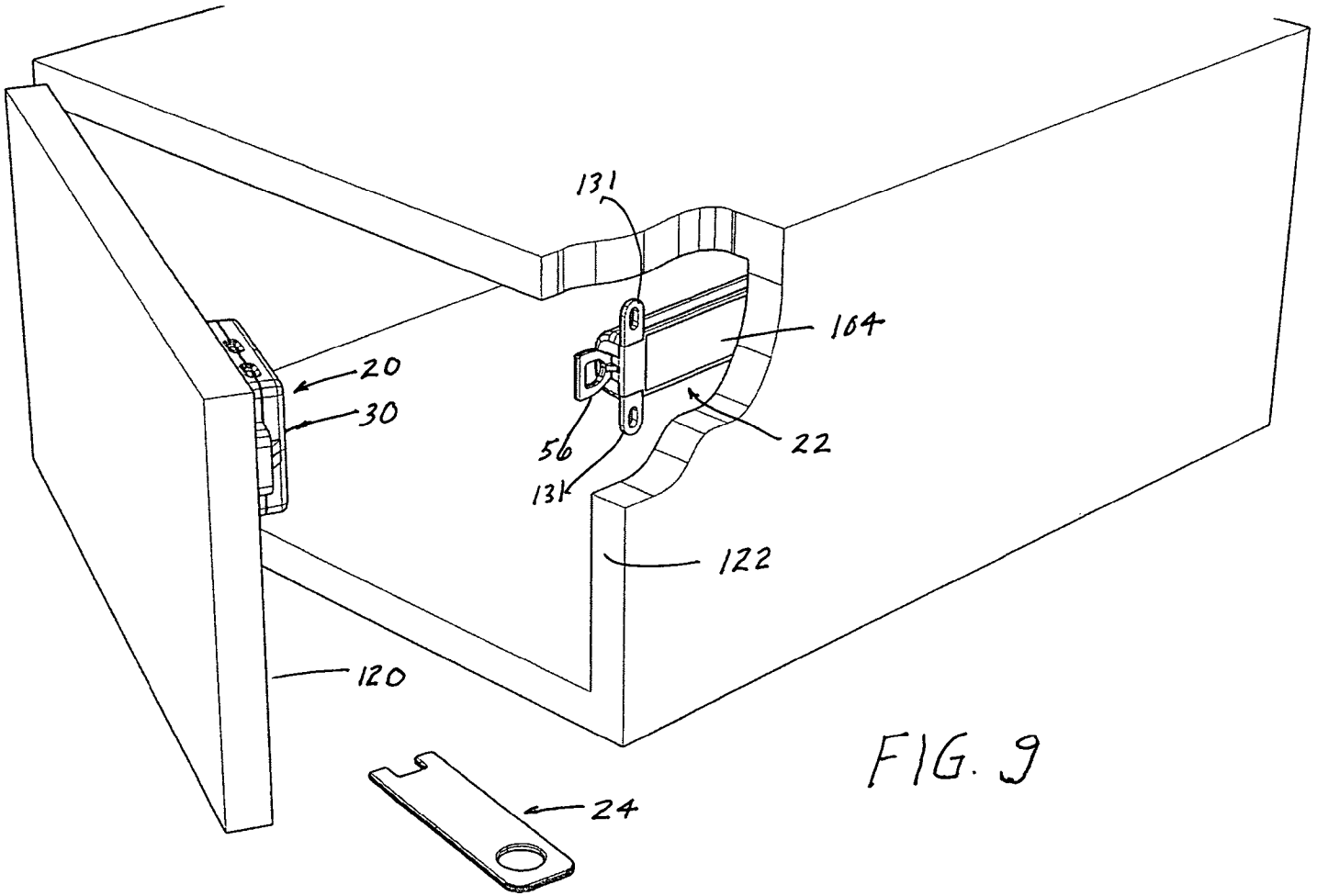
FIG. 9 is a perspective view of the lock assembly mounted to a door and door frame according to one embodiment of the present invention.

FIG. 9 illustrates a lock assembly 10 including a latch 20 mounted to a door 120 and a catch 22 mounted to a door frame 122 according to one embodiment. As shown, the latch 20 is mounted to a back surface of the door 120 and the catch 22 is mounted to a side wall of the inside of the door frame 122. It should be appreciated that in other embodiments, the latch 20 and catch 22 may be mounted differently, as the invention is not limited in this respect. For example, in one embodiment, the catch 22 may be mounted to a bottom wall or a top wall of the inside of the door frame 122 and the latch 20 may likewise be mounted to another location on the door 120. In this particular embodiment, the latch housing 30 is positioned such that side 26 of the latch housing 30 is upwardly facing so that slots on side 26 are accessible to a key 24 (shown hanging on the side of the door frame 122) for unlocking the lock assembly 10. In other embodiments, the latch housing 30 may be positioned such that the slots are accessible from the side and/or bottom of the door 120.

In one embodiment, the key 24 is insertable into either a first key slot on a first side of the housing or a second key slot of a second side of the housing. The key 24 may be substantially flat with two spaced-apart teeth for initiating movement of either pair of actuating levers.

The dimensions of the latch assembly and catch assembly may vary, as the invention is not limited in this respect. In one embodiment, the latch housing 30 has a length between approximately 1-4 inches, a width between approximately 1-3 inches, and a thickness between approximately 0.3-2 inches. More specifically, in one embodiment, the latch housing has a length of approximately 1.8 inches, a width of approximately 1.5 inches, and a thickness of approximately 0.5 inches. In one embodiment, the catch assembly 22 has a length between approximately 2-5 inches, a width between approximately 0.5-2 inches, and a thickness between approximately 0.3-2 inches. More specifically, in one particular embodiment, the catch assembly 22 has a length of approximately 3.2 inches, a width of approximately 0.8 inches, and a thickness of approximately 0.5 inches. It should be appreciated that the dimensions of the lock components may vary based upon the particular configuration of the door or drawer.

It should be appreciated that the materials used to manufacture the various components of a lock assembly may also vary. In one particular embodiment, the latch assembly 20 and catch assembly are made from a plastic material, and likewise the key 24 may also be made from a plastic material. However, in other embodiments, the components may be made from various metals and wood materials, as the invention is not limited in this respect.

It should be appreciated that various embodiments of the present invention may be formed with one or more of the above-described features. The above aspects and features of the invention may be employed in any suitable combination as the present invention is not limited in this respect. It should also be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one drawing figure, and/or may also encompass embodiments combining components illustrated in multiple different drawing figures.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. A latch assembly, comprising:

a housing configured to mount on a door or drawer;

a first and a second dog slidably mounted in the housing for movement only in a linear direction between a locked position and an unlocked position, wherein the first dog is separately moveable from the second dog;

a first pair of actuators in the form of levers pivotally mounted in the housing having one actuator operatively connected to the first dog and the other actuator operatively connected to the second dog for moving the dogs between the locked position and the unlocked position;

a second pair of actuators in the form of levers pivotally mounted in the housing having one actuator operatively connected to the first dog and the other actuator operatively connected to the second dog for moving the dogs between the locked position and the unlocked position;

a first key slot on a first side of the housing configured such that a key is insertable into the first key slot to move the first pair of actuators; and a second key slot on a second side of the housing configured such that a key is insertable into the second key slot to move the second pair of actuators.

2. The latch assembly of claim 1, wherein the first side of the housing is opposite the second side of the housing.

3. The combination of claim 1, wherein the catch includes a loop-shaped connector to engage at least a portion of the first and second dogs in the locked position.

4. The latch assembly of claim 1, in combination with a key configured to be insertable into either the first key slot or the second key slot, wherein the key is substantially flat with at least two spaced apart teeth for initiating movement of either the first or second pair of actuators.

5. The latch assembly of claim 1, wherein at least one of the first key slot and the second key slot includes two spaced apart openings in the housing.

6. The latch assembly of claim 1, further comprising at least one spring operatively connected to the first and second dogs biasing the dogs in the locked position.

7. The latch assembly of claim 1, wherein the housing includes a plurality of ribs extending out from an inside surface of the housing such that the ribs guide movement of the first and second dogs.

8. A door or drawer lock comprising:

a latch assembly for mounting on a door or drawer, the latch assembly comprising:

a housing;

a dog mounted in the housing and linearly movable between an extended locked position wherein at least a portion of the dog extends outside of the housing and a retracted unlocked position;

a first actuator positioned in the housing on a first side of and operatively connected to the dog for linearly moving the dog to the retracted unlocked position;

a second actuator positioned in the housing on a second side of and operatively connected to the dog for linearly moving the dog to the retracted unlocked position;

a first key slot in the housing adjacent the first actuator configured such that a card key is insertable into the first key slot to selectively move the first actuator to move the dog to the retracted unlocked position;

a second key slot in the housing adjacent the second actuator configured such that a card key is insertable into the second key slot to selectively move the second actuator to move the dog to the retracted unlocked position; and a catch assembly for mounting on a fixed door or drawer frame, wherein the catch assembly is constructed and arranged to engage at least a portion of the dog in the extended locked position, the catch assembly including a spring to enable movement of the latch assembly relative to the catch such that the door or drawer may open slightly while in the locked position enabling a key to be inserted into the key slot to move the dog to a retracted unlocked position.

9. The door or drawer lock of claim 8, wherein the actuators are levers pivotably mounted in the housing.

10. The door or drawer lock of claim 8, in combination with a key configured to be insertable into either key slot, wherein the key is substantially flat with at least two spaced apart teeth for initiating movement of either actuator.

11. The door or drawer lock of claim 8, further comprising at least one spring operatively connected to the dog biasing the dog in the extended locked position.

12. The door or drawer lock of claim 8, wherein the housing includes a plurality of ribs extending out from an inside surface of the housing such that the ribs guide movement of the dog between the extended position and the retracted position.

13. The door or drawer lock of claim 8, wherein the catch assembly includes a loop-shaped connector to engage at least a portion of the dog in the extended locked position.

14. A lock for child proofing a cabinet having a fixed frame with at least one drawer or door, the lock comprising:

a latch housing for mounting on the inner face of a moveable door or drawer;

a first and second dog separately moveable in the housing between a locked position where a locking portion of each of the dogs extends outside of the housing and an unlocked position where the locking portion of each of the dogs retracts into the housing;

a first pair of actuators mounted in the housing having one of its actuators operatively connected to the first dog and the other actuator operatively connected to the second dog for moving the dogs between the locked position and the unlocked position;

a second pair of actuators mounted in the housing having one of its actuators operatively connected to the first dog and the other actuator operatively connected to the second dog for moving the dogs between the locked position and the unlocked position;

first and second key openings on different portions of the housing, wherein the first key opening is near the first pair of actuators and the second key opening is near the second pair of actuators;

a catch for mounting on a fixed cabinet frame, the catch including a connector for engaging the locking portions of the first and second dogs to maintain the door or drawer in a closed position, wherein the door or drawer covers the key openings preventing access to said openings;

a spring forming part of the catch enabling the door or drawer to be opened against the bias of the spring just sufficiently to provide access to the key opening; and a key configured to be insertable into the first and second key openings so as to move either the first or second pair of actuators to withdraw the dogs from engagement with the catch connector.

15. The lock of claim 14, wherein the first key opening is on a first side of the housing and the second key opening is on a second side of the housing and the first side of the housing is opposite the second side of the housing.

16. The lock of claim 14, wherein the latch housing includes a plurality of ribs extending out from an inside surface of the latch housing such that the ribs guide movement of the first and second dog.

17. A latch assembly, comprising:

a housing configured to mount on a door or drawer;

a first and a second dog slidably mounted in the housing for movement only in a linear direction between a locked position and an unlocked position, wherein the first dog is separately moveable from the second dog;

a first pair of actuators mounted in the housing having one actuator operatively connected to the first dog and the other actuator operatively connected to the second dog for moving the dogs between the locked position and the unlocked position;

a second pair of actuators mounted in the housing having one actuator operatively connected to the first dog and the other actuator operatively connected to the second dog for moving the dogs between the locked position and the unlocked position;

a first key slot on a first side of the housing configured such that a key is insertable into the first key slot to move the first pair of actuators;

a second key slot on a second side of the housing configured such that a key is insertable into the second key slot to move the second pair of actuators, a catch configured to mount to a door or drawer frame, wherein the catch is constructed and arranged to engage at least a portion of the first and second dogs in the locked position, and a spring operatively connected to the catch to enable movement of the latch assembly relative to the catch such that the door or drawer may open slightly to access at least one of the first and second key slots.

* * * * *